US011525452B2

(12) United States Patent
Sun et al.

(10) Patent No.: US 11,525,452 B2
(45) Date of Patent: Dec. 13, 2022

(54) FAN FRAME BODY STRUCTURE

(71) Applicant: ASIA VITAL COMPONENTS CO., LTD., New Taipei (TW)

(72) Inventors: Sung-Wei Sun, New Taipei (TW); Chu-Hsien Chou, New Taipei (TW); Yi-Chih Lin, New Taipei (TW); Pei-Chuan Lee, New Taipei (TW); Wen-Hao Liu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 16/920,432

(22) Filed: Jul. 3, 2020

(65) Prior Publication Data

US 2020/0400156 A1 Dec. 24, 2020

Related U.S. Application Data

(63) Continuation-in-part of application No. 15/979,485, filed on May 15, 2018, now Pat. No. 10,746,024.

(51) Int. Cl.
*F04D 29/046* (2006.01)
*F04D 29/66* (2006.01)
*F04D 29/043* (2006.01)

(52) U.S. Cl.
CPC ..... *F04D 29/046* (2013.01); *F04D 29/043* (2013.01); *F04D 29/661* (2013.01)

(58) Field of Classification Search
CPC ..... F01D 25/24; H02K 5/20; F04D 19/002; F04D 27/009; F04D 27/0207–0238;
(Continued)

(56) References Cited

U.S. PATENT DOCUMENTS 7,723,875 B2 * 5/2010 Fakes ..... H02K 11/048 310/58
9,022,722 B2 * 5/2015 Liu ..... F04D 29/542 415/58.5

(Continued)

FOREIGN PATENT DOCUMENTS

CN 202301183 U 7/2012
CN 103967812 A 8/2014

(Continued)

OTHER PUBLICATIONS

Search Report dated Jan. 21, 2021 issued by Taiwan Intellectual Property Office for counterpart application No. 109122262.

(Continued)

*Primary Examiner* — Woody A Lee, Jr.
*Assistant Examiner* — Brian O Peters
(74) *Attorney, Agent, or Firm* — Demian K. Jackson; Jackson IPG PLLC

(57) ABSTRACT

A fan frame body structure includes a first frame body. The first frame body has a first upper end, a first lower end, a first frame wall and a first main flow way. The first main flow way passes through the first frame body and is formed with a first main inlet and a first main outlet respectively at the first upper end and the first lower end. A first subsidiary flow way is disposed in the first frame wall. The first subsidiary flow way is in parallel the first main flow way. The first subsidiary outlet is positioned at the first upper end of the first frame body in flush with and in adjacency to the first main inlet.

7 Claims, 4 Drawing Sheets

(58) Field of Classification Search
CPC ..... F04D 27/038; F04D 29/40; F04D 29/403; F04D 29/52; F04D 29/522; F04D 29/526; F04D 29/545; F04D 29/667; F04D 29/68; F04D 29/681; F04D 29/682; F04D 29/684
See application file for complete search history.

(56) References Cited

U.S. PATENT DOCUMENTS

| | | | | |
|---|---|---|---|---|
| 9,885,368 | B2 * | 2/2018 | Dygert | F04D 29/164 |
| 2013/0014842 | A1 * | 1/2013 | Liu | F04D 25/0613 137/565.3 |
| 2013/0251559 | A1 * | 9/2013 | Taroda | F04D 25/0613 417/410.1 |

FOREIGN PATENT DOCUMENTS

| | | | |
|---|---|---|---|
| CN | 106979178 | A | 7/2017 |
| CN | 108412816 | A | 8/2018 |
| CN | 212454971 | U | 2/2021 |
| JP | H03206398 | A | 9/1991 |
| KR | 20180125221 | A | 11/2018 |
| TW | M565243 | U | 8/2018 |
| TW | M602173 | U | 10/2020 |

OTHER PUBLICATIONS

Search Report dated Mar. 29, 2021 issued by China National Intellectual Property Administration for counterpart application No. 202010620975X.

* cited by examiner

FAN FRAME BODY STRUCTURE

The present application is a continuation in part of U.S. patent application Ser. No. 15/979,485, filed on Aug. 15, 2018.

BACKGROUND OF THE INVENTION

1. Field of the Invention

The present invention relates generally to a cooling fan, and more particularly to a fan frame body structure, which can guide the high-pressure airflow produced at the outlet of the fan to jet to the inlet so as to achieve multiple noise-lowering effects.

2. Description of the Related Art

The noise made by the fan in operation is always one of the problems existing in the field of fans to be improved. The conventional technical means for solving the fan noise problem is to use a circuit to control the rotational speed or change the fan structure. A conventional technique employs an airflow jet disposed on the dynamic blades or the frame wall of the static blades to restrain the vortex. However, it is necessary to add an external connected airflow jet source to the fan. This cannot be achieved in a limited space. In addition, the extra external connected airflow jet source will lead to increase of the cost.

It is therefore tried by the applicant to provide a fan frame body structure, which can lower the noise of the fan in operation without using any additional equipment.

SUMMARY OF THE INVENTION

It is therefore a primary object of the present invention to provide a fan frame body structure, in which a self-airflow jet structure is disposed on the fan frame body so that when the fan operates, the noise made at the airflow passage inlet or outlet can be lowered and the airflow amount can be increased.

To achieve the above and other objects, the fan frame body structure of the present invention includes a first frame body. The first frame body has a first upper end, a first lower end, a first frame wall and a first main flow way. The first main flow way passes through the first frame body and is formed with a first main inlet and a first main outlet respectively at the first upper end and the first lower end. A first subsidiary flow way is disposed in the first frame wall. The first subsidiary flow way is in parallel the first main flow way. The first subsidiary flow way is positioned on outer side of the first main flow way and has a first subsidiary outlet and a first subsidiary inlet. The first subsidiary outlet is positioned at the first upper end of the first frame body in flush with and in adjacency to the first main inlet. The first subsidiary inlet is adjacent to the first lower end of the first frame body in communication with the first main flow way.

In the structural design of the present invention, the first subsidiary flow way is formed in the first frame wall. When the airflow flows in from the first main inlet of the first frame body and flows to the first main outlet, the airflow will pour from the first subsidiary inlet into the first subsidiary flow way and finally exhaust from the first subsidiary outlet. The airflow is jetted to the first main inlet of the first frame body. Therefore, the problem of noise made by the fan in operation is greatly improved and the airflow amount is increased.

In addition, the first subsidiary flow way is disposed in parallel to the first main flow way. This facilitates the demolding operation of the first frame body, which is made by means of injection molding.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
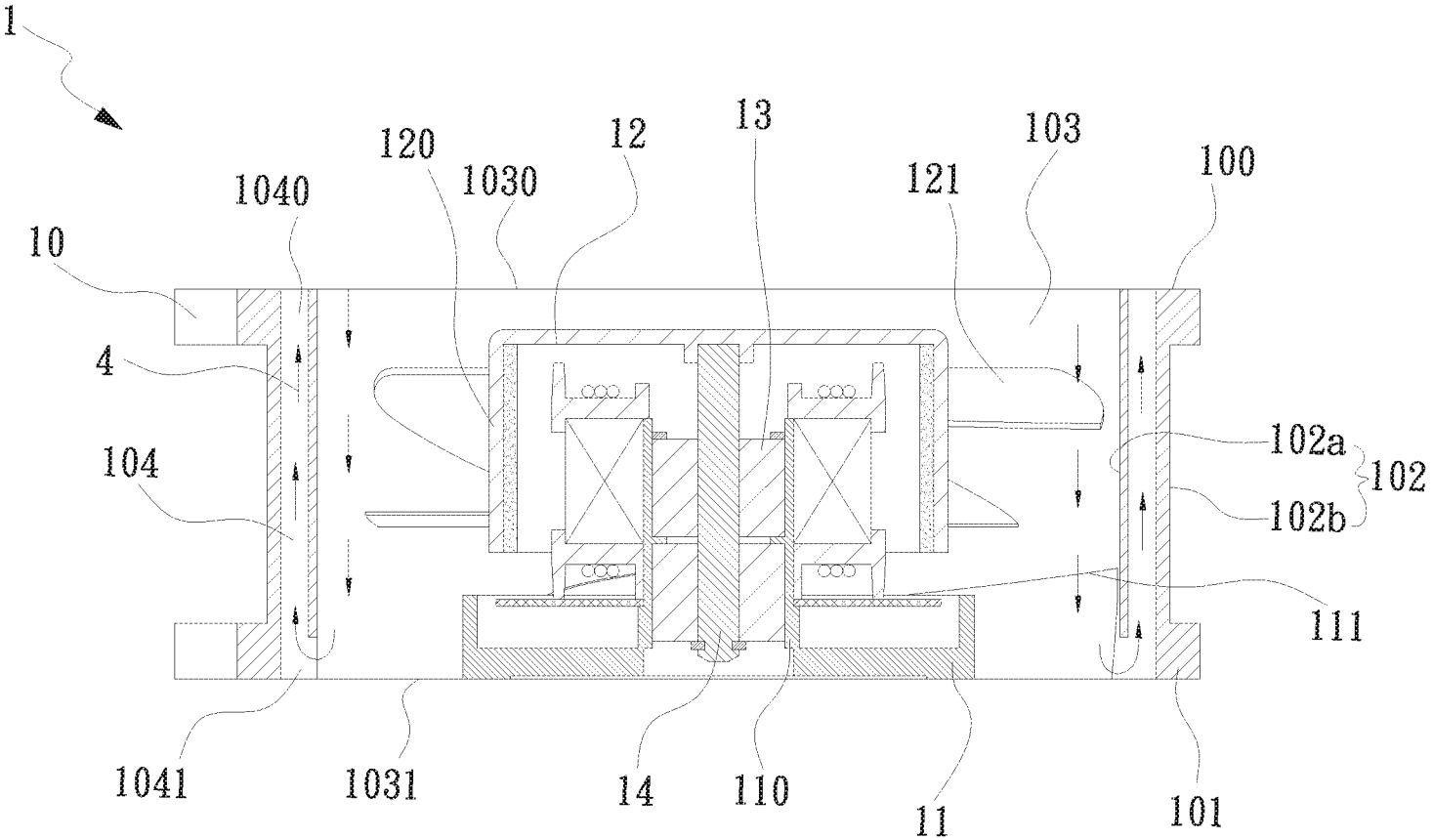
FIG. 1 is a sectional view of a first embodiment of the fan frame body structure of the present invention.

Please refer to FIG. 1, which is a sectional view of a first embodiment of the fan frame body structure of the present invention. As shown in the drawing, the fan frame body structure 1 of the present invention includes a first frame body 10. The first frame body 10 has a first upper end 100, a first lower end 101, a first frame wall 102 and a first main flow way 103. The first main flow way 103 passes through the first frame body 10 and is formed with a first main inlet 1030 and a first main outlet 1031 respectively at the first upper end 100 and the first lower end 101.

A first subsidiary flow way 104 is disposed in the first frame wall 102. The first subsidiary flow way 104 is spaced from the first main flow way 103 in parallel thereto. The first subsidiary flow way 104 is positioned on outer side of the first main flow way 103 and has a first subsidiary outlet 1040 and a first subsidiary inlet 1041. The first subsidiary outlet 1040 is positioned at the first upper end 100 of the first frame body 10 in flush with and in adjacency to the first main inlet 1030. The first subsidiary inlet 1041 is adjacent to the first lower end 101 of the first frame body 10 in communication with the first main flow way 103.

To speak more specifically, the first frame wall 102 has a first section 102*a* and a second section 102*b*. The first section 102*a* is adjacent to the first main flow way 103. The first subsidiary flow way 104 is positioned between the first and second sections 102*a*, 102*b*. In addition, the first subsidiary flow way 104 is partitioned from the first main flow way 103 by the first section 102*a*.

Moreover, a first fan impeller seat 11 is disposed in the first main flow way 103. The first fan impeller seat 11 has multiple first connection members 111 radially outward extending from the first fan impeller seat 11. The first connection members 111 are connected with the first frame wall 102 to support the first fan impeller seat 11 at the first main outlet 1031. A first bearing cup 110 vertically extends from the center of the first fan impeller seat 11. A first fan impeller set 12 is fitted around the first bearing cup 110. A first bearing 13 is disposed in the first bearing cup 110. The first fan impeller set 12 has a first hub 120 and multiple first blades 121 disposed on an outer circumference of the first hub 120. A first shaft 14 is inserted in the center of the inner side of the first hub 120. The first shaft 14 is rotatably disposed in the first bearing 13.

Accordingly, by means of the design of the present invention, the airflow 4 at the first main outlet 1031 is guided to enter the first subsidiary flow way 104 from the first subsidiary inlet 1041 and finally exhaust from the first subsidiary outlet 1040. The airflow 4 is jetted to the first main inlet 1030 of the first main flow way 103 of the first frame body 10. Therefore, the noise made at the first main inlet 1030 of the first frame body 10 can be greatly reduced and the airflow amount is increased.

Figure 2:
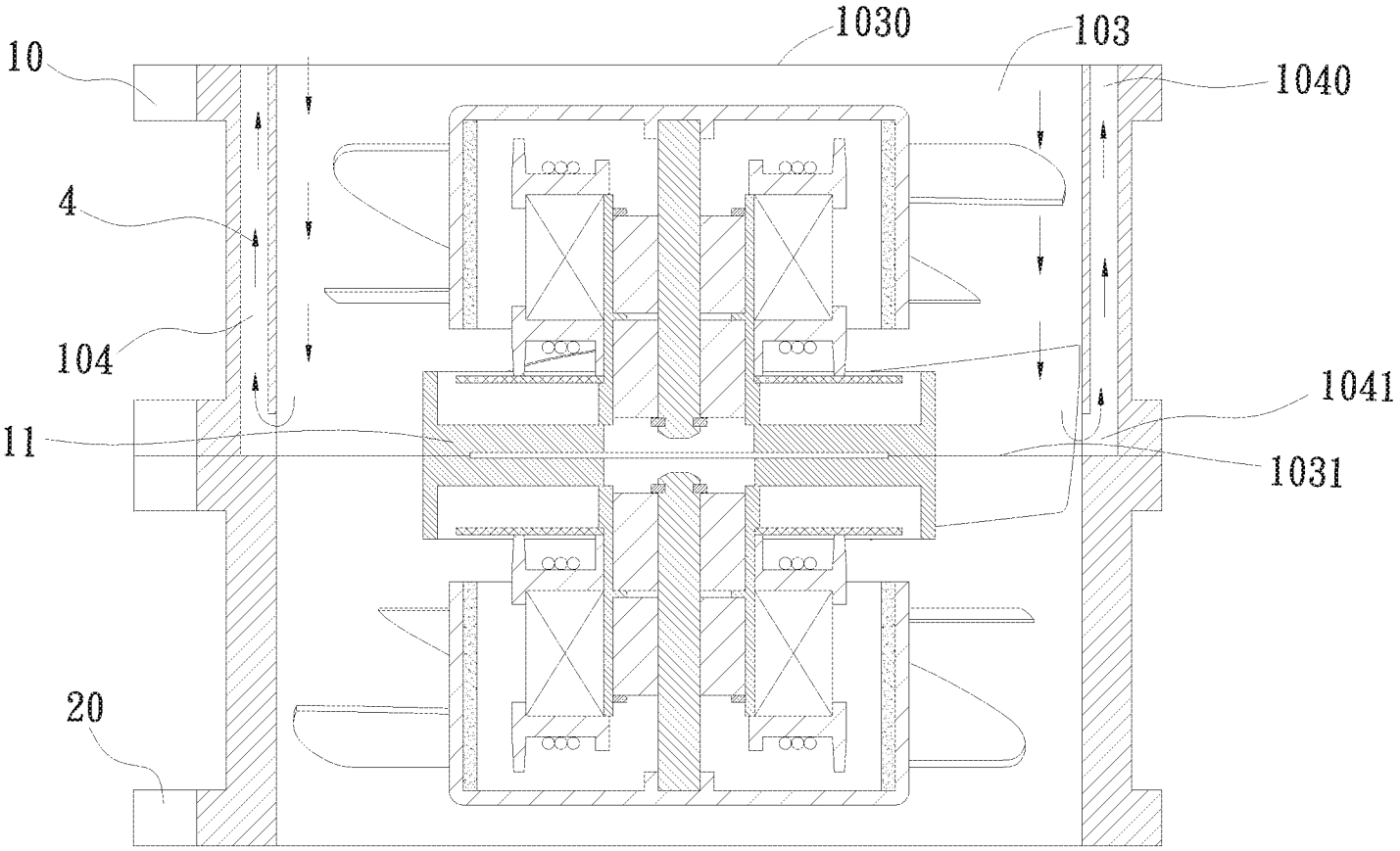
FIG. 2 is a sectional view of a second embodiment of the fan frame body structure of the present invention.

Please now refer to FIG. 2, which is a sectional view of a second embodiment of the fan frame body structure of the present invention. As shown in the drawing, the fan frame body structure 1 is a serially connected fan set including a first frame body 10 mated with a conventional fan. The conventional fan has a second frame body 20. The structure of the first frame body 10 is identical to the structure of the first frame body 10 of the first embodiment and thus will not be redundantly described hereinafter. The frame wall of the second frame body 20 has no subsidiary flow way structure. In this embodiment, the first frame body 10 is disposed at the upper wind inlet of the serially connected fan set. The bottom section of the first frame body 10 is mated with the bottom section of the second frame body 20. By means of the design of the first subsidiary flow way 104, the airflow 4 can enter the first subsidiary flow way 104 from the first subsidiary inlet 1041 and then exhaust from the first subsidiary outlet 1040. Thereafter, the airflow 4 is jetted to the first main inlet 1030 of the first main flow way 103 of the first frame body 10. Therefore, the problem of the noise made at the first main inlet 1030 can be improved.

Figure 3:
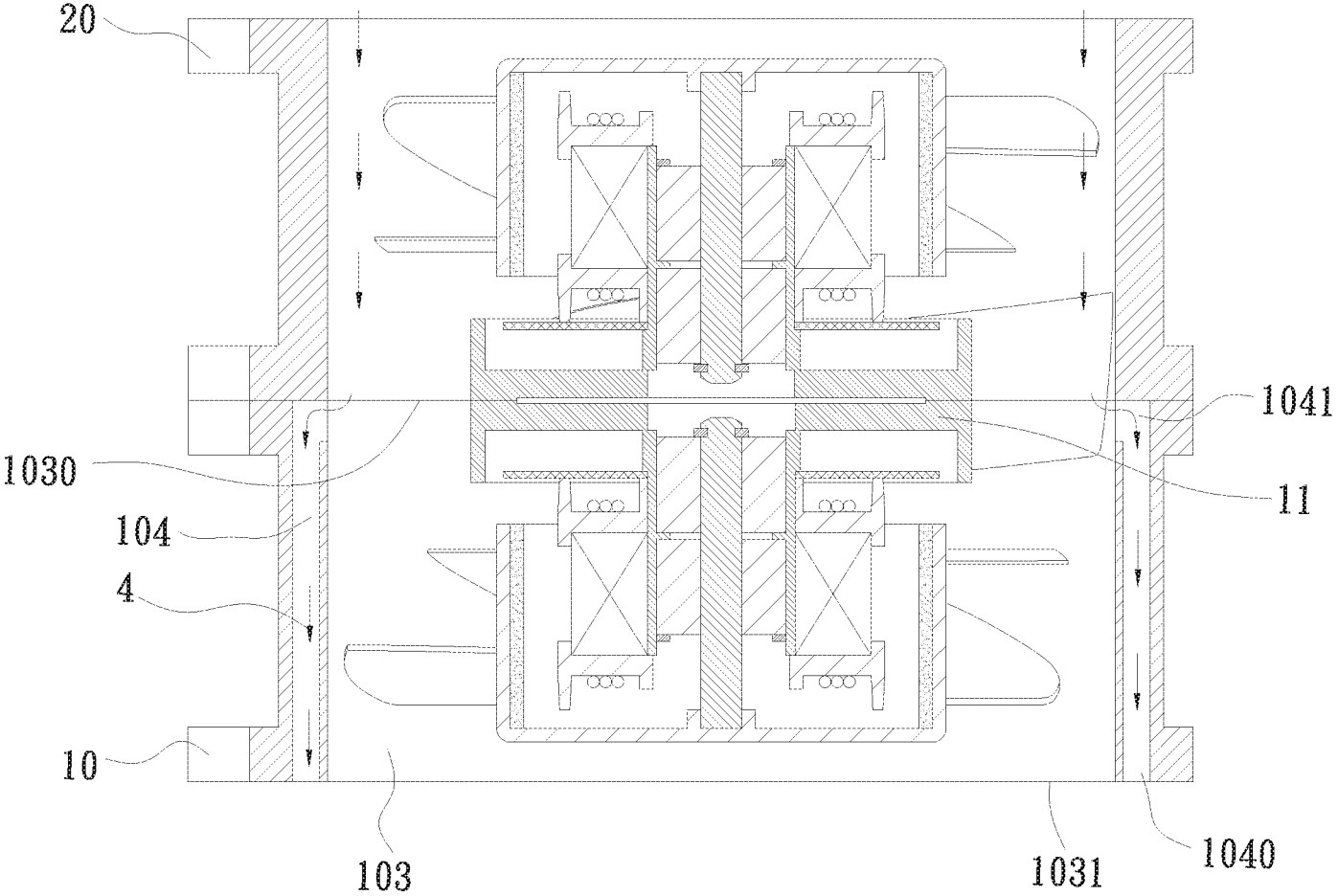
FIG. 3 is a sectional view of a third embodiment of the fan frame body structure of the present invention.

Please now refer to FIG. 3, which is a sectional view of a third embodiment of the fan frame body structure of the present invention. The third embodiment is different from the second embodiment in that the first frame body 10 is disposed at the lower wind outlet of the serially connected fan set. It should be noted that in this embodiment, the first main inlet 1030 and the first main outlet 1031 of the first frame body 10 are such designed as to be reverse to the second embodiment. Therefore, the noise made at the first main inlet 1030 of the first frame body 10 is reduced and the airflow amount is increased.

Figure 4:
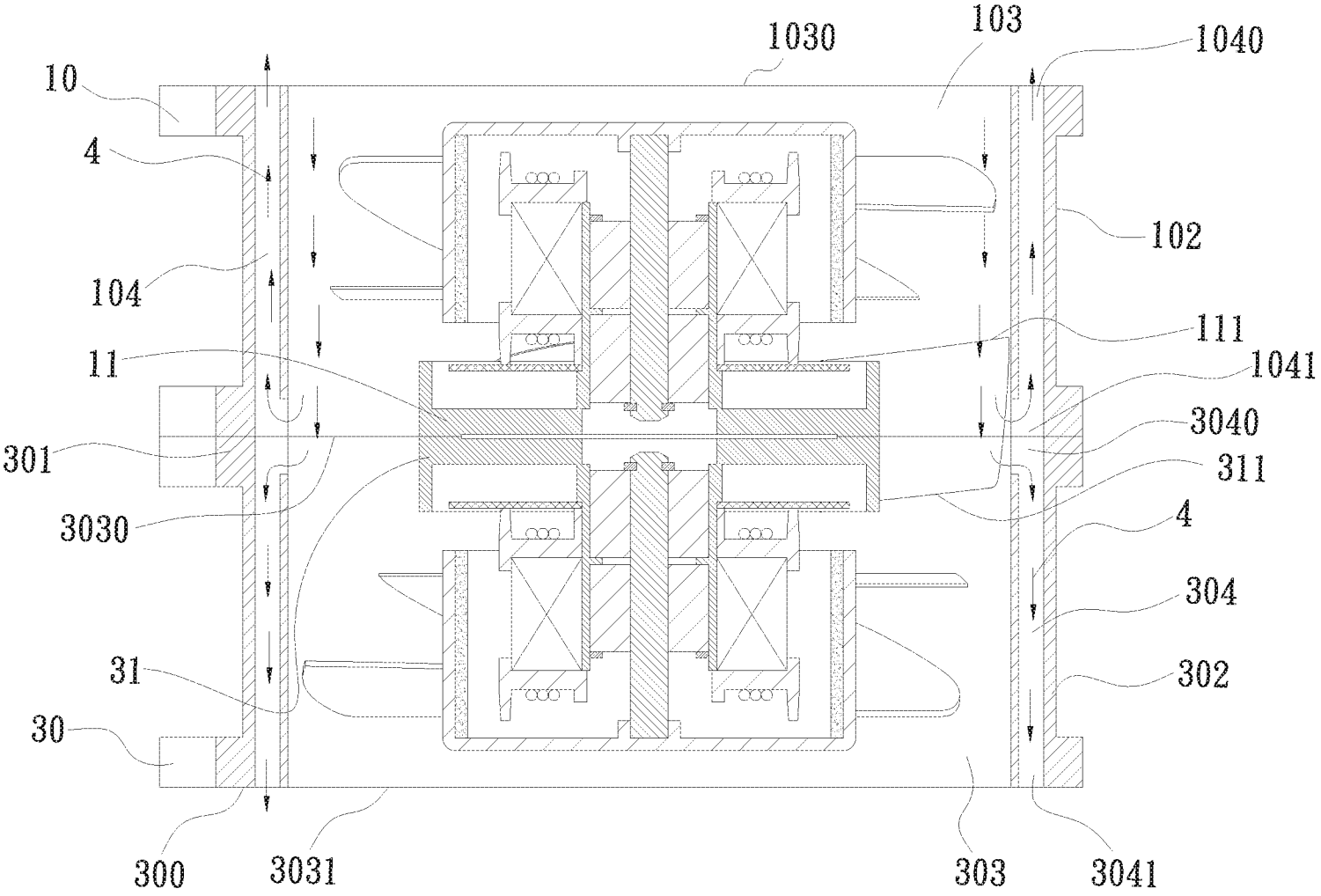
FIG. 4 is a sectional view of a fourth embodiment of the fan frame body structure of the present invention.

Please now refer to FIG. 4, which is a sectional view of a fourth embodiment of the fan frame body structure of the present invention. The fourth embodiment is partially identical to the first embodiment in structure and thus will not be redundantly described hereinafter. The fourth embodiment is different from the first embodiment in that the fourth embodiment further has a third frame body. The bottom section of the third frame body 30 is serially connected with the bottom section of the first frame body 10. The third frame body 30 has a third upper end 300, a third lower end 301, a third frame wall 302 and a third main flow way 303. The third main flow way 303 passes through the third frame body 30 and is formed with a third main outlet 3031 and a third main inlet 3030 respectively at the third upper end 300 and the third lower end 301. In this embodiment, the first and third frame bodies 10, 30 are serially connected and the first main outlet 1031 and the third main inlet 3030 are mated with each other, whereby the first and third main flow ways 103, 303 are in communication with each other. A third fan impeller seat 31 is disposed in the third main flow way 303. The third fan impeller seat 31 has multiple third connection members 311 radially outward extending from the third fan impeller seat 31. The third connection members 311 are connected with the third frame wall 302 to support the third fan impeller seat 31 at the third main inlet 3030.

A third subsidiary flow way 304 is disposed in the third frame wall 302. The third subsidiary flow way 304 is spaced from the third main flow way 303 in parallel thereto. The third subsidiary flow way 304 is positioned on outer side of the third main flow way 303 and has a third subsidiary inlet 3040 and a third subsidiary outlet 3041. The third subsidiary inlet 3040 is positioned at the third lower end 301 of the third frame body 30 and slightly lower than the third main inlet 3030 in parallel thereto. The third subsidiary outlet 3041 is adjacent to the third end 300 of the third frame body 30. The first and third subsidiary flow ways 103, 304 of the first and third frame bodies 10, 30 are in communication with each other or not in communication with each other. In this embodiment, the first and third subsidiary flow ways 103, 304 of the first and third frame bodies 10, 30 are in communication with each other for illustration purposes.

The bottom sections of the first and third frame bodies 10, 30 are serially connected with each other. The first and third connection members 111, 311 are disposed on the serially connected sections. The airflow 4 flows into the first and third main flow ways 103, 303 from the upper first main inlet 1030 of the first frame body 10. Then the airflow 4 flows to the first main outlet 1031. Due to the first and third connection members 111, 311, the airflow 4 is boosted to create greater pressure. Part of the airflow 4 flows from the first subsidiary inlet 1041 into the first subsidiary flow way 104 to exhaust from the first subsidiary outlet 1040. Then the airflow 4 is jetted to the upper first main inlet 1030 of the first main flow way 103 of the first frame body 10. Other part of the airflow 4 flows to the lower third subsidiary inlet 3040 of the third frame body 30 into the third subsidiary flow way 304 to exhaust from the third subsidiary outlet 3041. Then the airflow 4 is jetted to the lower third main outlet 3031 of the third main flow way 303 of the third frame body 30. Therefore, the problem of noise made at the upper first main inlet 1030 of the first frame body 10 and the lower third main outlet 3031 of the third frame body 30 is improved. Accordingly, after serially connected, the upper first frame body 10 and the lower third frame body 30 have self-airflow jetting effect.

This can greatly improve the noise problem of the fan in operation. In conclusion, in comparison with the conventional fan, the present invention has the following advantages:

1. The fan frame body has self-airflow jetting effect.
2. The noise made by the fan in operation is greatly reduced.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan frame body structure comprising:

a first frame body having a first upper end, a first lower end, a first frame wall, and a first main flow way, the first main flow way passing through the first frame body and being formed with a first main inlet and a first main outlet respectively at the first upper end and the first lower end, a first subsidiary flow way being disposed in the first frame wall, the first subsidiary flow way being in parallel the first main flow way, the first subsidiary flow way being positioned on an outer side of the first main flow way and having a first subsidiary outlet and a first subsidiary inlet, the first subsidiary outlet being positioned at the first upper end of the first frame body flush with and in adjacency to the first main inlet, the first subsidiary inlet being adjacent to the first lower end of the first frame body and in communication with the first main flow way, wherein a first fan impeller seat is disposed in the first main flow way, the first fan impeller seat having multiple first connection members radially outward extending from the first fan impeller seat, the first connection members being connected with the first frame wall to support the first fan impeller seat at the first main outlet;

a second frame body mated with the first frame body; and a third frame body having a third upper end, a third lower end, a third frame wall, and a third main flow way, the third main flow way passing through the third frame body and being formed with a third main outlet and a third main inlet respectively at the third upper end and the third lower end, a third subsidiary flow way being disposed in the third frame wall in parallel to the third main flow way and positioned on an outer side of the third main flow way and having a third subsidiary inlet and a third subsidiary outlet.

2. The fan frame body structure as claimed in claim 1, wherein the first frame wall has a first section and a second section, the first section being adjacent to the first main flow way, the first subsidiary flow way being positioned between the first and second sections, the first subsidiary flow way being partitioned from the first main flow way by the first section.

3. The fan frame body structure as claimed in claim 1, wherein a first bearing cup vertically extends from a center of the first fan impeller seat, a first fan impeller set is fitted around the first bearing cup, a first bearing is disposed in the first bearing cup, the first fan impeller set having a first hub and multiple first blades disposed on an outer circumference of the first hub, a first shaft is inserted in a center of inner side of the first hub, and the first shaft is rotatably disposed in the first bearing.

4. The fan frame body structure as claimed in claim 1, wherein the third subsidiary inlet is positioned at the third lower end of the third frame body and lower than the third main inlet in parallel thereto, the third subsidiary outlet being adjacent to the third upper end of the third frame body in communication with the third main flow way.

5. The fan frame body structure as claimed in claim 4, wherein a third fan impeller seat is disposed in the third main flow way, the third fan impeller seat having multiple third connection members radially outward extending from the third fan impeller seat, the third connection members being connected with the third frame wall to support the third fan impeller seat at the third main inlet.

6. The fan frame body structure as claimed in claim 4, wherein the first and third subsidiary flow ways are in communication with each other.

7. The fan frame body structure as claimed in claim 4, wherein the first and third subsidiary flow ways are not in communication with each other.

* * * * *